United States Patent [19]

Wallace

[11] 4,060,128

[45] Nov. 29, 1977

[54] TERTIARY CRUDE OIL RECOVERY PROCESS

[76] Inventor: William J. Wallace, 5815 Queensloch, Houston, Tex. 77096

[22] Filed: Oct. 1, 1976

[21] Appl. No.: 728,871

[51] Int. Cl.[2] ..... E21B 43/25

[52] U.S. Cl. ..... 166/249; 166/314

[58] Field of Search ... 166/62, 68, 105, 177, 249, 314; 299/14

[56] References Cited

U.S. PATENT DOCUMENTS

| | | | |
|---|---|---|---|
| 3,220,476 | 11/1965 | Brandon | 166/249 |
| 3,322,196 | 5/1967 | Bodine, Jr. | 166/177 X |
| 3,578,081 | 5/1971 | Bodine | 166/249 |
| 2,670,801 | 3/1954 | Sherborne | 166/249 |
| 2,700,422 | 1/1955 | Bodine, Jr. | 166/249 |
| 2,705,460 | 4/1955 | Burdick | 166/177 X |
| 3,339,635 | 9/1967 | Brandon | 166/249 |
| 3,378,075 | 4/1968 | Bodine | 166/314 |
| 3,527,300 | 9/1970 | Phillips | 166/249 |

*Primary Examiner*—Stephen J. Novosad
*Assistant Examiner*—George A. Suchfield

[57] ABSTRACT

The present invention relates to a new and improved tertiary crude oil recovery process or secondary recovery process for recovery of hydrocarbons which includes placing a sonic source in a well bore to emit sonic waves which disturbs the earth structure containing unrecovered hydrocarbons and enables the pull of gravity to move the hydrocarbons into the area of an oil well lift pump.

1 Claim, 1 Drawing Figure

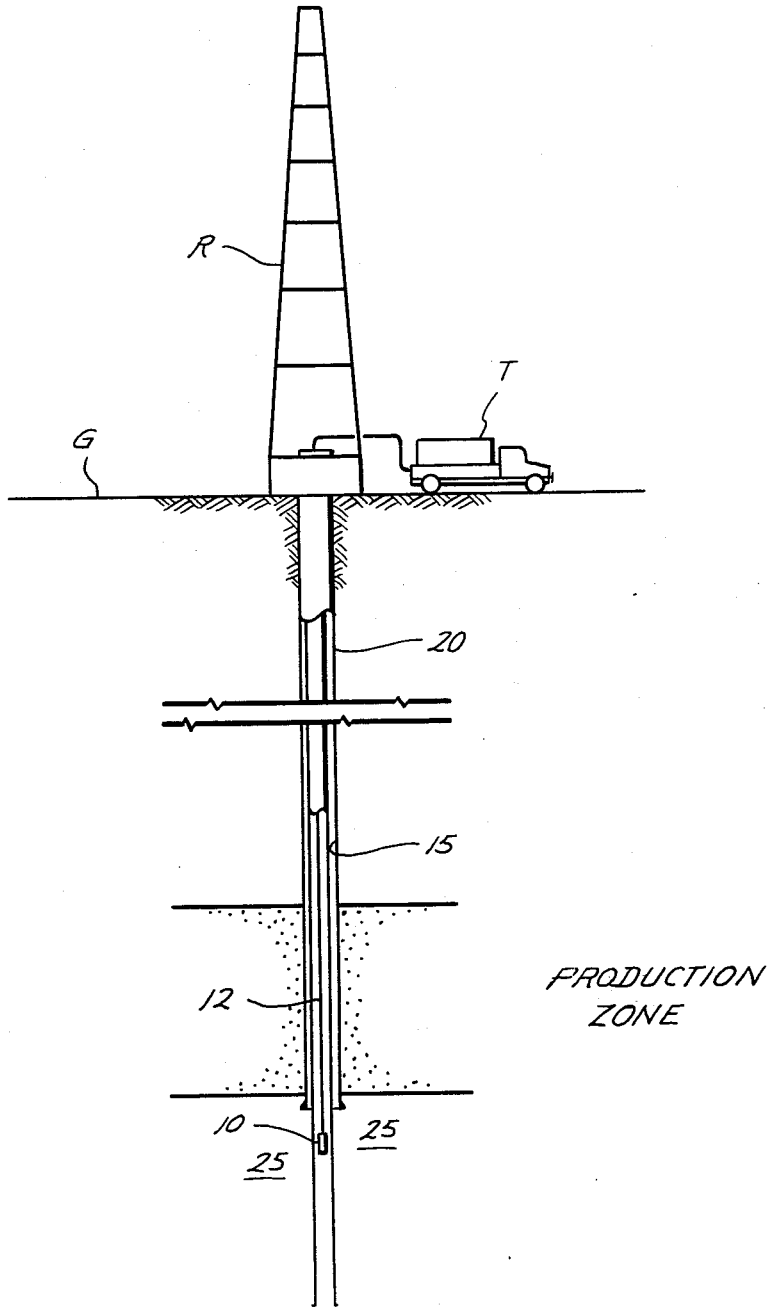
R
T
G
20
15
12
PRODUCTION ZONE
10
25
25

TERTIARY CRUDE OIL RECOVERY PROCESS

BACKGROUND OF THE INVENTION

Field of the Invention

The present invention relates to a new and improved process and method wherein a sonic source is placed in a well bore to utilize sonic emissions therefrom for enhancing the recovery of hydrocarbons within the vicinity of the vibrations by reducing the surface tension of the hydrocarbon droplets thereby causing, because of the gravitational pull, such droplets to move to the well bore and its corresponding lift pump. Further, the hydrocarbons also flow toward the well bore because of the return "echo" wave from the sonic source which is the path of least resistance for the release of such hydrocarbon droplets.

Prior Art

There are many prior art recovery processes for tertiary or secondary hydrocarbon recovery. These processes include the various forms of injection of some liquid, gas, explosive substance or inducing subterranean fire in the oil bearing sands in igniting a flammable gas or liquid injected into the oil bearing sand area in conjunction with the injection of oxygen. All of such prior art processes were successful to a degree but involved the expenditure, due to injection, of valuable resources and a great expenditure of time, effort, talent and money. Such prior art forms or processes in use are known as water flood, gas flood, fire flood, miscible gas injection, polymer flood, steam injection, and sand or hydro fracking, acidizing, bacterial seeding, nuclear fractionization, and nuclear stimulation.

In addition, one other process known to the applicant utilizes high frequency shock waves for recovery of hydrocarbons. Such shock waves are initiated by a special explosive to produce a fracturing effect into hydrocarbon bearing formations enabling tertiary recovery.

The patent to Bodine, No. 3,578,081 discloses the use of an electro-acoustic transducer positioned within the well bore casing for the recovery of hydrocarbons. The Bodine process is ineffective since the transducer is positioned within the well bore casing which dampens and distorts the sonic waves and depends on the casing itself to transmit any vibrational forces. Other dampening factors which affect the sonic waves would include not only the surrounding packed drilling mud but also any string of casing and packers which would absorb any vibrational transmissions since such casing string and packers are traditionally designed to withstand a certain amount of vibration and shock to withstand well bottom "kicks" from sudden influx of high pressure in the well bore.

The patent to Brandon, No. 3,422,894 discloses the use of a fluid medium to act as an acidizing or displacement medium that comingles with the oil and is later withdrawn as the oil is produced and separated for commercial use. The use of a sonic force in this instance is redundant and ineffective due the dampening effect on the sonic force.

In addition, other patents of interest are U.S. Pat. No. 3,322,196 to Bodine; No. 2,670,801 to Sherborne; No. 3,527,300 to Phillips; No. 3,339,635 to Brandon; No. 2,918,126 to Bodine; No. 3,016,095 to Bodine; No. 2,700,422 to Bodine; No. 3,497,005 to Felix, et al.; No. 3,323,592 to Brandon and No. 3,422,894 to Brandon.

SUMMARY OF THE INVENTION

Briefly, the present invention involves the steps of positioning a mechanical sonic source at or in the vicinity of the base of a casing string in a well bore. The sonic source may be driven by air, gas, electric or steam power, all of which is well known in the art. The vibrational force is transmitted directly into the surrounding earth strata, through sonic resonating means or sound waves to distort and alter the surrounding strata structure to thereby reduce surface tension by capillary alteration of the sand and hydrocarbon formation to enable the oil to drop down and toward the sonic source and thus the adjacent well bore pump because of the pull of gravity and return echo sonic wave force. Hydrocarbons held within such subterranean strata is thus freed by distortion and strata ligament fracture brought about by such vibational forces and enabled to travel to the well bore following the line of least resistance—the altered strata structure surrounding the implanted vibrator.

BRIEF DESCRIPTION OF THE DRAWING

The drawing discloses a perspective partial sectional view of the present invention.

DESCRIPTION OF THE PREFERRED EMBODIMENT

As illustrated in the figure, a suitable sonic source 10 such as a conventional transducer or vibrator is driven by suitable power such as air, gas, electrical or steam power (not shown). The source 10 is illustrated as being suspended from a cable 12 in a well bore 15 enclosed by suitable casing 20. The cable 12 is mounted on the earth's surface or ground G to a suitable cable truck T adjacent the well bore 15 and rig R. The cable 12 may also act and provide support for a suitable power line to drive such sonic source 10.

As further illustrated in the drawing, the casing extends down the well bore 15 a certain distance and the sonic source 10 is placed below the casing in the well bore 15 so that the generation of sonic waves will not be dampened by the casing and so that the casing will not be damaged due to vibration.

As further illustrated in the drawing, the sonic source 10 is placed below the production zone for a purpose to be brought out hereinafter.

With the sonic source 10 in position, power is supplied to the sonic source 10 such that the sonic source emits sonic waves which disturb and excite the earth's strata to cause hydrocarbons within the production zone to settle downwardly and toward such sonic source 10 by reducing surface tension of the hydrocarbons droplets. The principle underlying this surface tension is sympathetic vibration within the surface of the oil droplets to the main source of vibration from the sonic source 10 as the sonic source vibration establishes a vibratory relationship and response with the oil bearing earth grains in the production zone. This effect is in keeping with the old established chladni figure effect of vibrated sand grains seeking an area of least disturbance.

This vibratory relationship with the oil bearing earth grains is timed to correspond to the natural frequency of vibration of the oil of such oil bearing earth grains and carried to the oil bearing earth grains in the production zone. Thus, the strata 25 acts as a resonating medium following Newton's Law of Acceleration between the oil bearing strata or earth grains in the production zone and the sonic source 10.

The reduction in surface tension of the oil droplets and/or oil bearing earth grains occurs because of the natural law of capillarity. As the surrounding earth strata or earth grains 25 are vibrated by the sonic source 10, the adhesing hydrocarbon liquids experience changes in the orifices among the strata production zone, such as sands, forming the capillaries thus enabling surface tension to hold the oil in a state of suspension contrary to the law of gravity. As these capillaries are vibrated they thus become altered and surface tension is reduced following the formula $$2\pi rT = \pi r^2 hdg$$

(where: $\pi r$ is the radius of the capillary existing in the hydrocarbon bearing sands, $T$ is the surface tension of the hydrocarbon droplet in situ, $h$ is the height of the elevation of the hydrocarbon droplet in the capillary, $d$, the density of the hydrocarbon, and $g$, dynes of force acting against gravity) as the capillary is alternately widened ($r$) and narrowed by vibration to enable the pull of gravity to overcome the surface tension ($T$ in the formula since capillarity width is inversely proportional to the surface tension) in the hydrocarbon droplets to pull the hydrocarbons downwardly and thus pool such hydrocarbons.

As this occurs, the hydrocarbons move towards the sonic source 10 along the return echo path of the emitted sonic waves from the sonic source 10 because of the fact that the sonic source 10 imposes a force vector which acts upon the moving and settling hydrocarbons to thus cause a gradual movement of the hydrocarbons toward the sonic source 10.

Thereafter, a suitable downhole pump (not shown) lifts the oil to the surface of the earth or ground G for use as desired.

What is claimed is:

1. A method for secondary recovery of hydrocarbons from a well bore having a casing and hydrocarbon pump therein comprising the steps of:

a. Positioning a sonic source below the casing in the well bore and below the desired production zone;

b. Transmitting power to the sonic source to thereby cause said sonic source to emit sonic waves through the earth's stata to the desired production zone;

c. Changing the orifices among the earth's strata surrounding the hydrocarbons by using the sonic waves emitted from the sonic source to thus change the surface tension of the hydrocarbons in the production zone;

d. Producing the hydrocarbons with the hydrocarbon pump due to the hydrocarbons gravitating to the well bore because the reduction of surface tension of the hydrocarbons enables the hydrocarbons to fall downwardly toward the well bore and follow the return echo force vector wave emanating toward the sonic source.

* * * * *